US011988009B2

(12) United States Patent
Crandall et al.

(10) Patent No.: US 11,988,009 B2
(45) **Date of Patent: *May 21, 2024**

(54) FENCE BRACE SYSTEM ADAPTED FOR USE WITH CORNER POST ARRANGEMENTS

(71) Applicants: Fonda Crandall, Reno, NV (US); Joseph Crandall, Reno, NV (US)

(72) Inventors: Fonda Crandall, Reno, NV (US); Joseph Crandall, Reno, NV (US)

( * ) Notice: Subject to any disclaimer, the term of this patent is extended or adjusted under 35 U.S.C. 154(b) by 674 days.

This patent is subject to a terminal disclaimer.

(21) Appl. No.: 17/198,820

(22) Filed: Mar. 11, 2021

(65) Prior Publication Data

US 2021/0198920 A1 Jul. 1, 2021

Related U.S. Application Data

(60) Continuation-in-part of application No. 16/881,653, filed on May 22, 2020, now Pat. No. 10,995,518, which is a continuation-in-part of application No. 16/517,584, filed on Jul. 20, 2019, now Pat. No. 10,697,198, which is a continuation-in-part of application No. 15/856,741, filed on Dec. 28, 2017, now Pat. No. 10,597,898, which is a division of application No. 14/863,793, filed on Sep. 24, 2015, now Pat. No. 10,030,408.

(51) Int. Cl.
*E04H 17/14* (2006.01)

(52) U.S. Cl.
CPC ..... *E04H 17/1413* (2013.01); *E04H 17/143* (2013.01); *E04H 17/1447* (2021.01); *E04H 17/1473* (2021.01); *E04H 17/1482* (2021.01)

(58) Field of Classification Search
CPC ..... E04H 17/1413; E04H 17/1417; E04H 17/1426; E04H 17/143; E04H 17/1439; E04H 17/1447; E04H 17/1473; E04H 17/1482
See application file for complete search history.

(56) References Cited

U.S. PATENT DOCUMENTS 4,526,348 A * 7/1985 Cammack ..... F16B 7/0486 29/525.04
5,403,110 A * 4/1995 Sammann ..... E04B 1/5831 52/712
6,290,214 B1 * 9/2001 DeSouza ..... E04H 17/1413 52/712

(Continued)

FOREIGN PATENT DOCUMENTS

GB 275 371 * 8/1927 ..... E04H 17/1413
GB 677 092 * 8/1952 ..... E04H 17/1413

*Primary Examiner* — Michael P Ferguson

(57) ABSTRACT

The present invention comprises a brace adapted to secure one or more fence rails to a fence post. The present invention brace may optionally be installed onto an existing fence or on a new fence. The invention includes a fence post brace member adapted to connect to one or more sides of a fence post and a fence rail brace member adapted to connect to two or more sides of a fence rail. The fence post brace member may form a vertical picket fastener slot for use in affixing a picket to the fence post. The fence post brace system may be adapted for use with corner fence post arrangements such as those having a fence rail positioned above and supported by the fence post and those defining a channel for receiving a fence rail.

5 Claims, 9 Drawing Sheets

(56) References Cited

U.S. PATENT DOCUMENTS

| | | | | |
|---|---|---|---|---|
| 7,398,621 | B2 * | 7/2008 | Banta | F16B 7/0486 52/713 |
| 10,697,198 | B2 * | 6/2020 | Crandall | E04H 17/1417 |
| 10,995,518 | B2 * | 5/2021 | Crandall | E04H 17/1417 |
| 2014/0223745 | A1 * | 8/2014 | Eberhart | E04B 1/58 403/373 |

* cited by examiner

FENCE BRACE SYSTEM ADAPTED FOR USE WITH CORNER POST ARRANGEMENTS

BRIEF DESCRIPTION OF THE INVENTION

The present invention relates to the field of fences. More particularly, the present invention relates to a system for providing structural support for fences including for fences having corner fence post arrangements including fence arrangements wherein the fence rail is positioned above the fence post and wherein a fence rail is attached to only a first side of the fence post.

The present invention provides strength for building a new fence or repairing an existing fence. The fence would not need to be removed or modified to install the herein disclosed brace. Installation would be simple. The brace could be mass produced at low cost. The color and style of the brace could be easily adapted to match aesthetically with the fence and the surrounding area. The brace itself may be painted, stained, powder coated, colored, or made with a colored metal. The brace may also be built into a new fence. The present invention optionally includes embodiments adapted for fences with rectanguloid rails or for rectanguloid fence posts. The present invention may be optionally optimized for a fence with corner fence posts arrangements. The brace may be made of strong weather-resistant material such as steel, stainless steel, galvanized steel, aluminum, plastic, graphite, wood, or any composite material(s).

CROSS-REFERENCES TO RELATED APPLICATIONS

This non-provisional utility application is a continuation-in-part (CIP) of the pending continuation-in-part (CIP) U.S. application Ser. No. 16/881,653 filed on May 22, 2020 titled "Fence Brace System" and of the U.S. Pat. No. 10,697,198 (application Ser. No. 16/517,584) titled "Fence Brace System" filed on Jul. 20, 2019 and of the U.S. Pat. No. 10,597,898 (application Ser. No. 15/856,741) titled "Fence Brace System" filed on Dec. 28, 2017 and U.S. Pat. No. 10,030,408 (application Ser. No. 14/863,793) titled "Fence Brace System" originally filed on Sep. 24, 2015, which are hereby incorporated in their entirety by reference.

STATEMENTS AS TO THE RIGHTS TO INVENTIONS MADE UNDER FEDERALLY SPONSORED RESEARCH OR DEVELOPMENT

Not applicable.

REFERENCE TO A "SEQUENCE LISTING," A TABLE, OR A COMPUTER PROGRAM LISTING APPENDIX SUBMITTED ON A COMPACT DISK

Not applicable.

BACKGROUND OF THE INVENTION

Fence and fence structure are subject to damage due to high winds, torrential rains, heavy snowfall, vehicular accidents, termites, vandalism, earthquakes and falling trees and branches. The most common of these causes is high winds. Wind damages fences all around the world every year. Fences made of wood are especially susceptible to wind damage because wood is weakened by prolonged exposure to rain, snow, wind, and other elements.

Despite the potential for damage, wood is still by far the most common residential fencing material in the United States. In 2007 alone, Americans put up 59,000 miles of wood fencing, enough to circle the globe twice. Wood is inexpensive and lightweight, and a wood fence can easily be shaped to give properties character and individuality. There are many styles, including linear post-and-rail and criss-crossing lattice, as well as myriad picket patterns and post-cap designs. And the wood may be painted or stained to match almost any landscape.

Fences could be built much stronger through the use of heavy materials such as steel and sturdy construction. However, this might drive the costs of the fence up above what is acceptable. As well, there are the aesthetic considerations discussed above. Also, it is unlikely that a property owner would replace an existing fence merely because of the possibility that it could be damaged by the elements.

There is an unmet need, therefore, for an inexpensive way to provide a fence with additional structural support. The need is especially great with respect to existing fences and with respect to wooden fences.

DETAILED DESCRIPTION OF THE INVENTION

Figure 1:
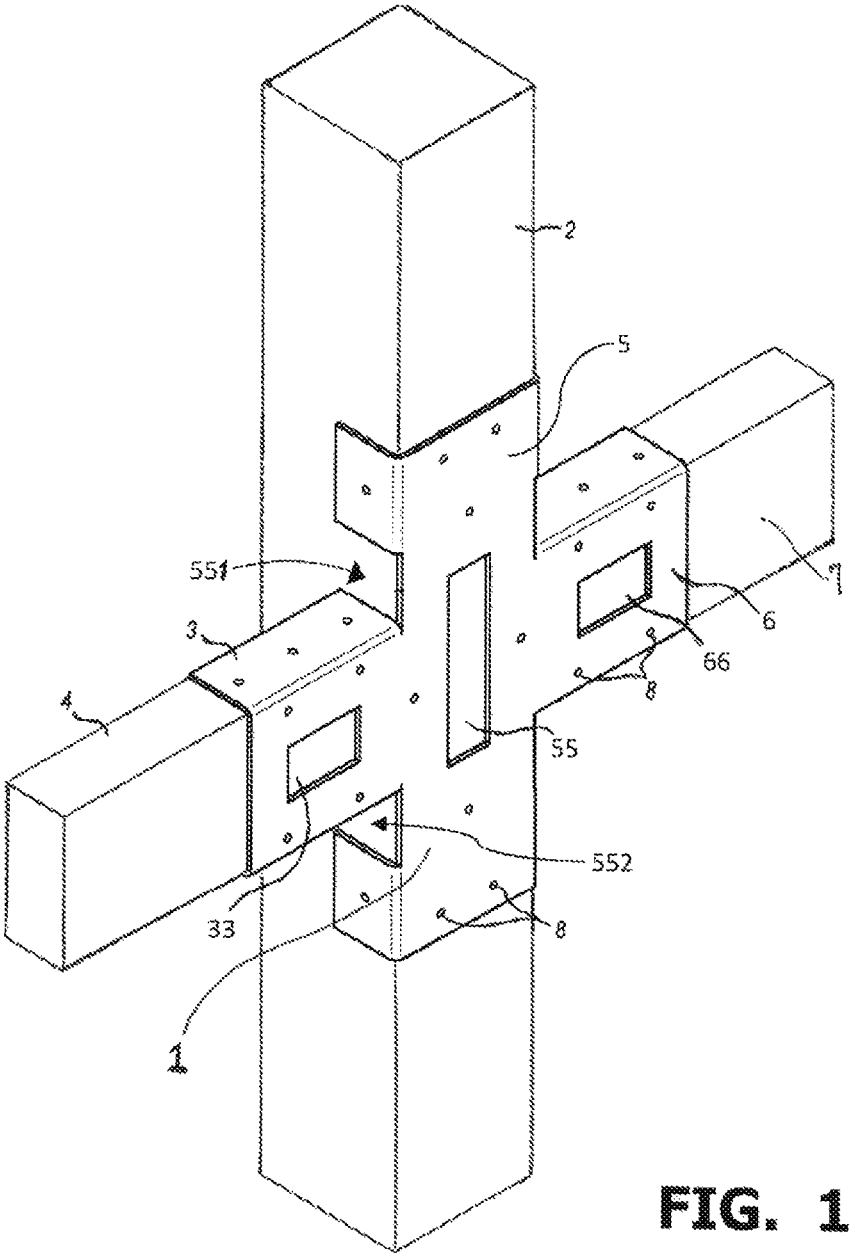
FIG. 1 illustrates an isometric view of an embodiment of a fence brace that supports a connection between a rectanguloid fence post to two linearly disposed rectanguloid fence rails wherein one or more cutouts are formed by the fence brace in accordance with the present invention.

As illustrated in FIG. 1, the present invention comprises fence brace 1 for securing at least one fence rail 4 to fence post 2 including first fence rail brace member 3 adapted to connect to two or more sides of first fence rail 4. First fence rail brace member 3 may be fused to a first side of fence post brace member 5 wherein fence post brace member 5 is adapted to connect to two or more sides of fence post 2. The fence rail may be rectanguloid. As used herein, the term "rectanguloid" means a solid (3-dimensional) object which has six faces that are rectangles. It has the same cross-section along a length. As used herein, "rectanguloid" is the same as a rectangular prism. A rectanguloid may be thought of as a 3-dimensional version of a rectangle or a square. The herein disclosed fence brace system may further include second fence rail brace member 6 fused to a second side of fence post brace member 5, wherein second fence rail brace member 6 is adapted to connect to two or more sides of second fence rail 7.

Fence brace 1 may include plurality of holes a thereby allowing fence post brace member 5 to be securely fastened to fence post 2 and thereby allowing first fence rail brace member 3 to be securely fastened to first fence rail 4 and second fence rail brace member 6 to be securely fastened to second fence rail 7. The plurality of holes may be referred to as screw-holes, nail holes, bolt holes, or other fastener holes. The plurality of holes may each receive a screw, a nail, a bolt, or an alternative type of fastener for securely connecting fence brace 1 to the fence post and/or the fence rail(s). The various figures illustrate the plurality of holes positioned in exemplary locations; those skilled in the art will recognize that the plurality of holes may be formed in various locations on the fence brace to provide the intended benefit of allowing secure attachment of the fence brace to the fence (the fence post and the fence rails).

Fence brace 1 may be formed of a strong weather-resistant material such as selected from the group consisting of steel, stainless steel, galvanized steel, aluminum, plastic, graphite, wood, or any composite material(s).

An embodiment of the present invention may further include one or more picket fastener slots for allowing one or more pickets (or boards) to be attached to the fence. For example, and as illustrated in FIG. 1, fence post brace member 5 forms vertical picket fastener slot 55, first fence rail brace member 3 forms first horizontal picket fastener slot 33, and second fence rail brace member 6 forms second horizontal picket fastener slot 66. This embodiment allows for attachment of a picket to fence post 2 through vertical picket fastener slot 55, attachment of a picket to first fence rail 4 through first horizontal picket fastener slot 33, and/or attachment of a picket to second fence rail 7 through second horizontal picket fastener slot 66. After fastening one or more pickets through the respective picket fastener slot, the herein disclosed fence brace is positioned in between the fence and the picket.

Referring to FIG. 1, an upper flange cutout 551 is formed on each side of the upper flange and a lower flange cutout 552 is formed on each side of the lower flange. Illustrated in FIG. 1 an upper flange cutout 551 is formed on each side of the upper flange and a lower flange cutout 552 is formed on each side of the lower flange.

Figure 2:
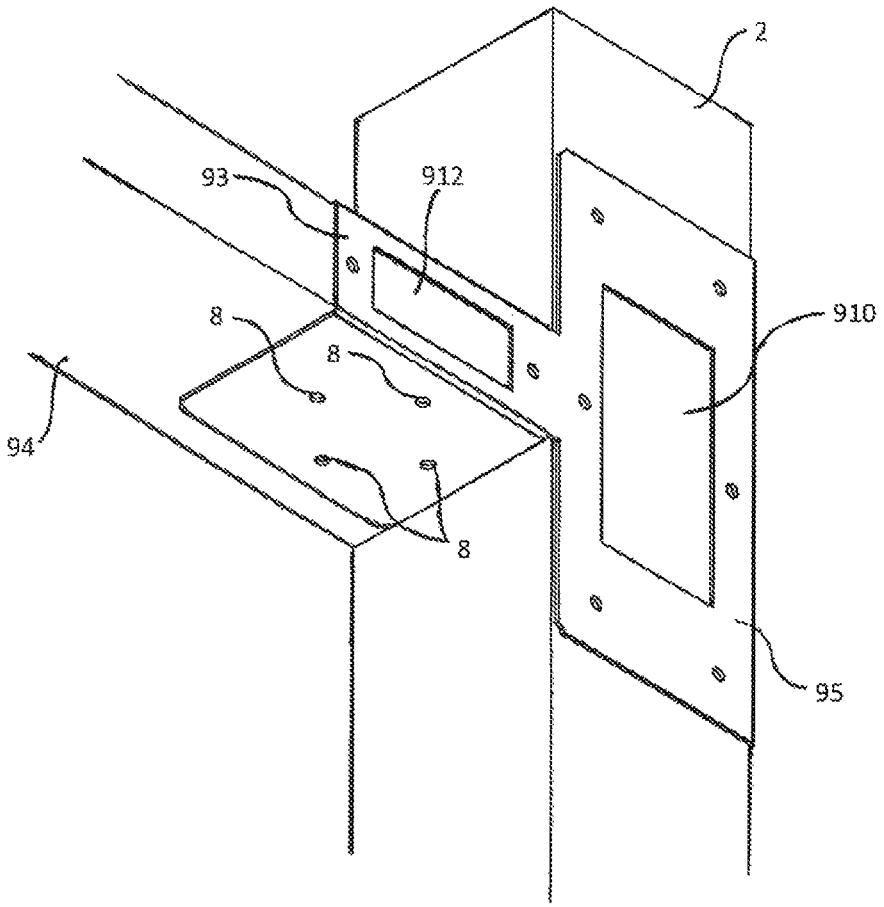
FIG. 2 illustrates an isometric view of an embodiment of a fence assembly having a rectangular fence post and a rectangular fence rail having a horizontal orientation supported by a fence brace having a fence post brace member and a fence rail brace member in accordance with the present invention.

Referring to FIG. 2, an embodiment of the fence brace and fence brace assembly are shown that provide for securing a fence rail 94 to fence post 2 via a fence brace having a single fence rail flange (fence rail flange 93). The fence assembly shown in FIG. 2 through FIG. 3 include: fence post 2 having a rectangular cross-section; fence rail 94 having a rectangular cross-section; fence post brace member 95 forming a first picket fastener slot 910 for receiving a fastener therethrough to affix a picket to fence post 2 with the fence post brace member therebetween and having a rearward-protruding wall defining a channel for receiving fence post 2; and fence rail brace member 93 having a fence rail flange comprising a central wall forming a second picket fastener slot 912 and a pair of rearward-protruding walls extending along a horizontal longitudinally-extending edge of the central wall, the wall of the fence rail flange defining a channel for receiving fence rail member 94 therein. Fence rail brace member 93 may form a plurality of fastener holes 8 (which maybe disposed within the central wall and/or the rearward-protruding wall of the fence rail flange) for receiving fasteners to secure fence rail 94 therein. The first picket fastener slot 910 may extend longitudinally past a point defined by an extended edge of the central wall of the fence post brace member 95.

The fence post brace member 95 and fence rail brace member 93 maybe formed of any material sufficiently rigid so as to provide adequate support to fence post 2—fence rail 94 connection. In a preferred embodiment, fence post brace member 95 and fence rail brace member 93 are made of steel, stainless steel, galvanized steel, aluminum, plastic, graphite, or wood, or any composite material(s).

The fence assembly may include fence rail 94 that is horizontally oriented, meaning that the fence rail is positioned so that it is wider than it is tall. Alternatively, the fence assembly may include fence rail 94 that is vertically oriented, meaning that fence rail 94 is positioned so that it is taller than it is wide.

Figure 3:
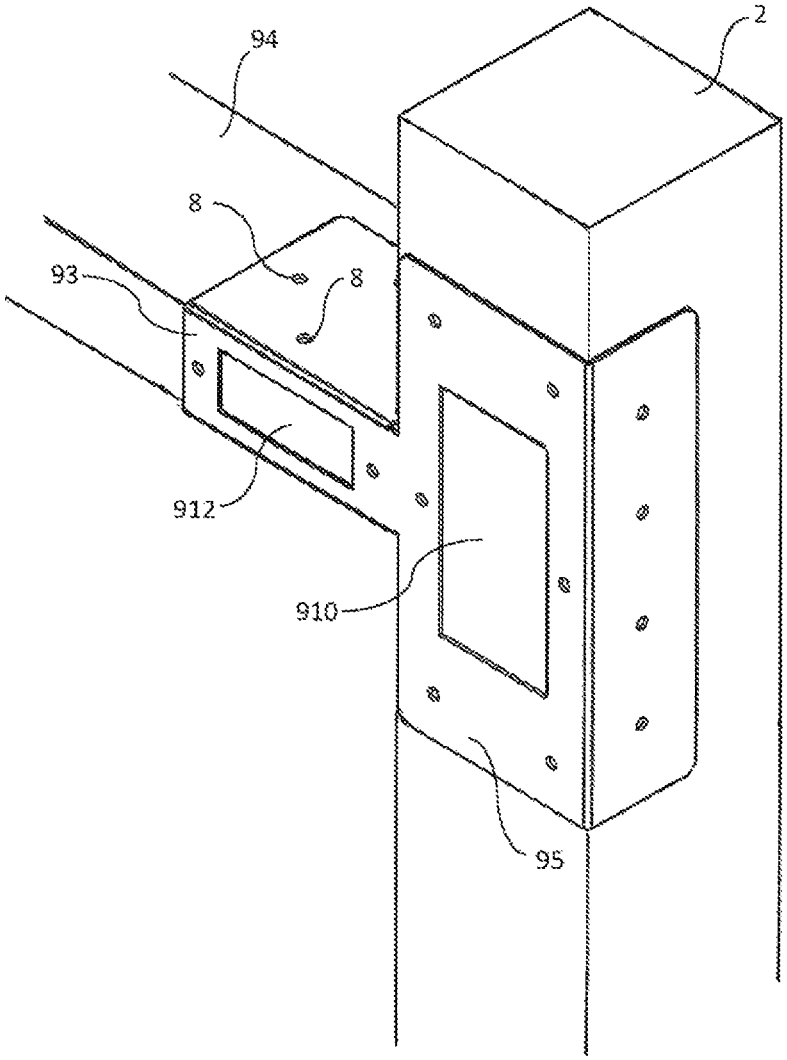
FIG. 3 illustrates an alternative isometric view of an alternative embodiment of a fence assembly shown in FIG. 2 having a rectangular fence post and a rectangular fence rail having a horizontal orientation supported by a fence brace having a fence post brace member and a fence rail brace member in accordance with the present invention.

Referring to FIG. 2 through FIG. 3, fence post brace member 95 forms first picket fastener slot 910, which may be vertically oriented and may extend longitudinally past a point defined by an extended edge of the central wall of fence rail flange 93.

In certain embodiments in the present invention, fence rail flange 93 forms a second picket fastener slot 912 and a plurality of fastener holes 8 for receiving a fastener to affix fence rail flange 93 to fence rail 94. Fence rail 93 forms a pair of rearward-protruding walls that define a channel for receiving fence rail 94.

Figure 4:
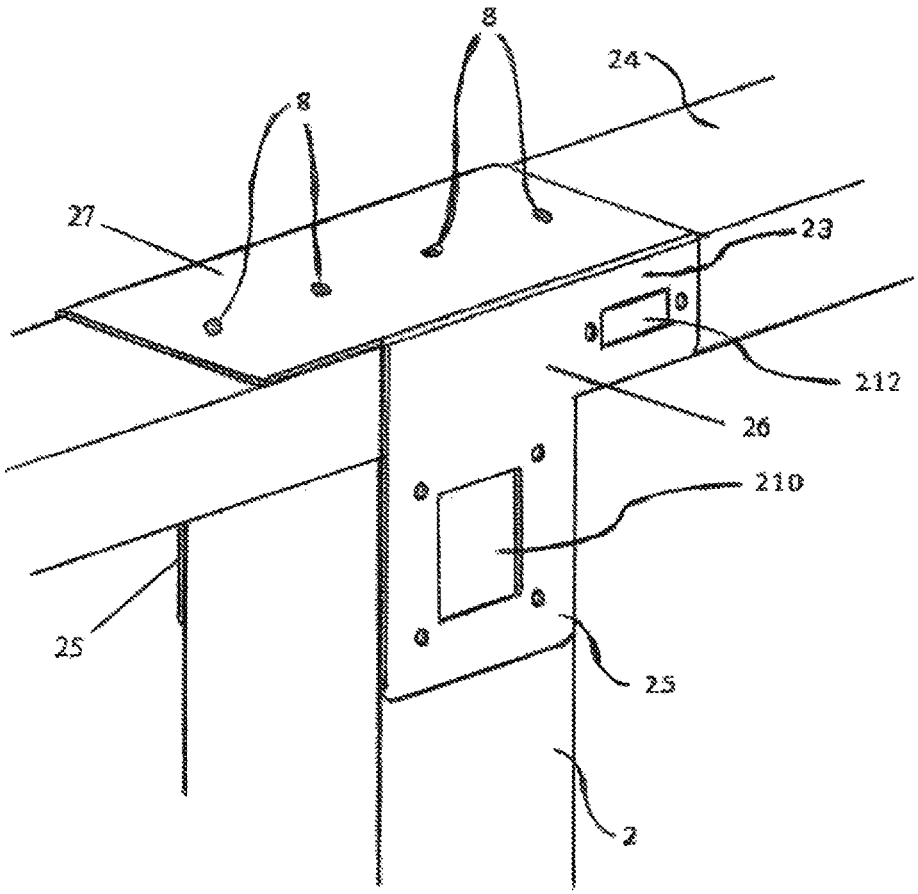
FIG. 4 illustrates an isometric view of an embodiment of a fence assembly adapted for use with one or more fence rails positioned above the fence post so that the fence rail is supported by the fence post and may extend continuously above and past the fence post and wherein a second picket fastener slot is formed by a fence rail member in accordance with the present invention.
Figure 5:
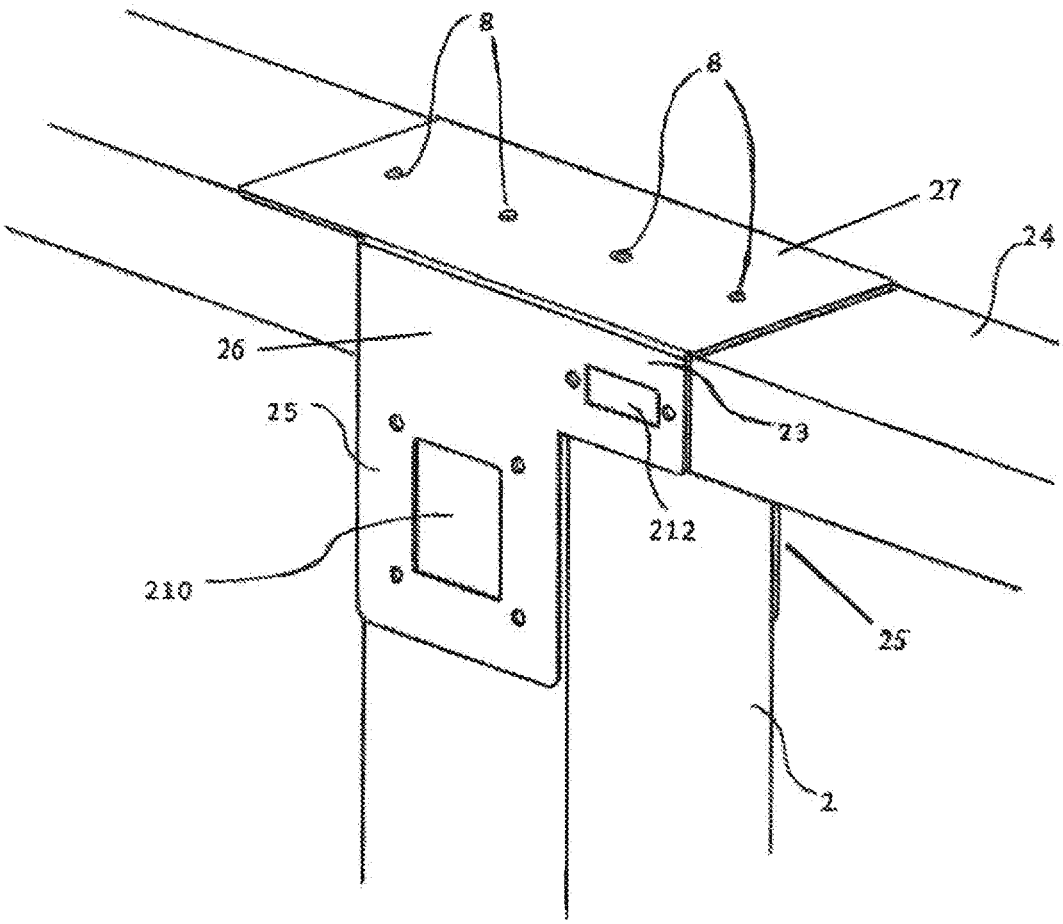
FIG. 5 illustrates an alternative isometric view of the embodiment illustrated in FIG. 4 of a fence assembly adapted for use with one or more fence rails positioned above the fence post so that the fence rail is supported by the fence post and may extend continuously above and past the fence post and wherein a second picket fastener slot is formed by fence rail member in accordance with the present invention.

Referring specifically to FIG. 4 through FIG. 5, fence post brace member 25 forms first picket fastener slot 210. Fence rail flange 23 forms a plurality of fastener holes 8 for receiving one or more fasteners to secure the fence brace to fence rail 24. Fence rail flange 23 includes a rearward-protruding wall 27 that defines on two sides a channel for receiving fence rail 24. In certain embodiments, fence fastener slot 210 may extend longitudinally through fence post brace member 25 and beyond a point defined by an extended edge of fence rail flange 23. Fence rail flange 23 may form a second picket fastener slot 212 for receiving a fastener therethrough to affix a second picket to fence rail 24.

Figure 6:
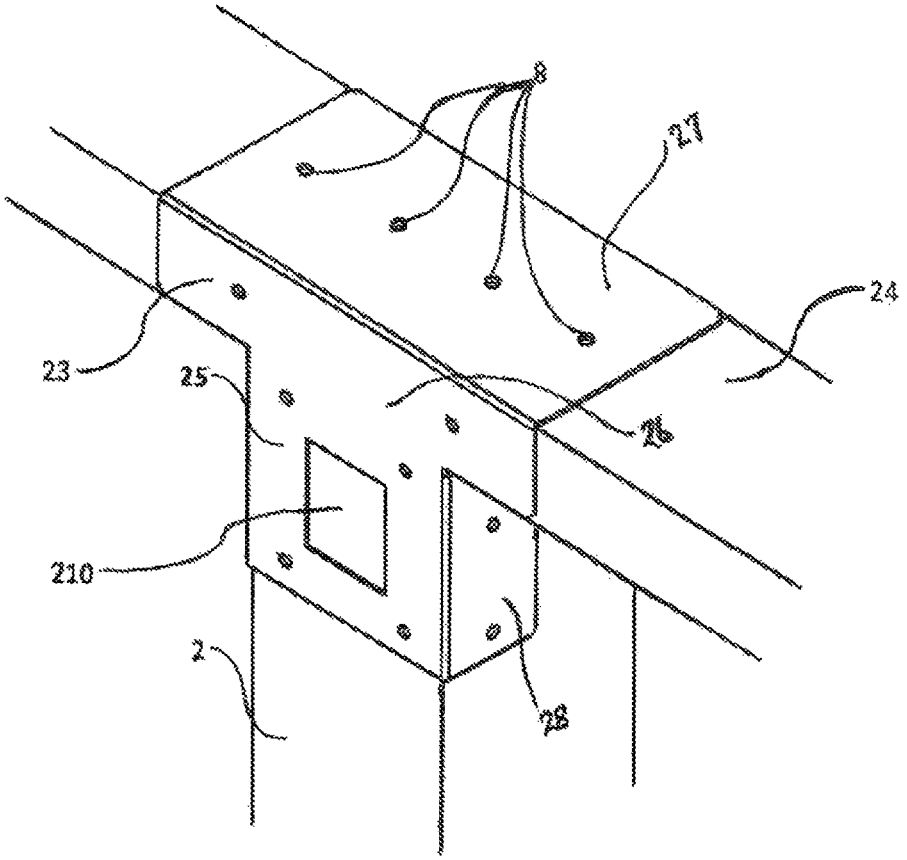
FIG. 6 illustrates an isometric view of a differing alternative embodiment of a fence assembly adapted for use with one or more fence rails positioned above the fence post so that the fence rail is supported by the fence post and may extend continuously above and past the fence post in accordance with the present invention.

Referring to FIG. 6, an embodiment of the herein disclosed fence assembly that shows the adapted for use for one or more fence rails 24 positioned above and supported by fence post 2 so that the fence rail may extend horizontally past fence post 2. This embodiment may include: fence post 2 having a rectangular cross-section; fence rail 24 having a rectangular cross-section and positioned above and supported by fence post 2; a fence post brace member 25 forming a picket fastener slot 210 for receiving a fastener therethrough to affix a picket to fence post 2 with the fence post brace member 25 therebetween; and fence rail brace member 23 having a flange comprising a planar central wall 26 and a rearward-protruding wall 28 extending along a horizontal longitudinally-extending edge of the central wall 27, the wall of the fence rail flange defining a channel for receiving fence rail 24 therein. A plurality of fastener 8 maybe disposed within, or formed by, central wall 27 and the rearward-protruding wall 28 of the fence rail flange for receiving fasteners to secure fence rail 24 therein. Picket fastener slot 210 maybe formed by fence post brace member 25 for receiving a fastener therethrough to affix a picket to fence post 2.

Referring specially to FIG. 6, fence post brace member 25 forms first picket fastener 210. Looking to FIG. 6, fence post brace member 25 may have rearward-protruding walls 28 defining a channel for receiving fence post 2, though other embodiments may not utilize rearward-protruding walls 28 on fence post brace member 25. Fence rail flange 23 forms a plurality of fastener holes 8 for receiving one or more fasteners to secure the fence brace to fence rail 24. Fence rail flange 23 includes a rearward-protruding wall 28 that defines on two sides a channel for receiving fence post 2. In certain embodiments, picket fastener slot 210 may extend longitudinally through fence post brace member 25 and beyond a point defined by an extended edge of fence rail flange 23.

Fence post brace 25 and fence rail brace member 23 may be formed of any material sufficiently ridged so as to provide adequate support to fence post 2—fence rail 24 connection. In a preferred embodiment, fence post brace member 25 and fence rail brace member 23 are made of steel, stainless steel, galvanized steel, aluminum, plastic, graphite, or any composite material(s).

Figure 7:
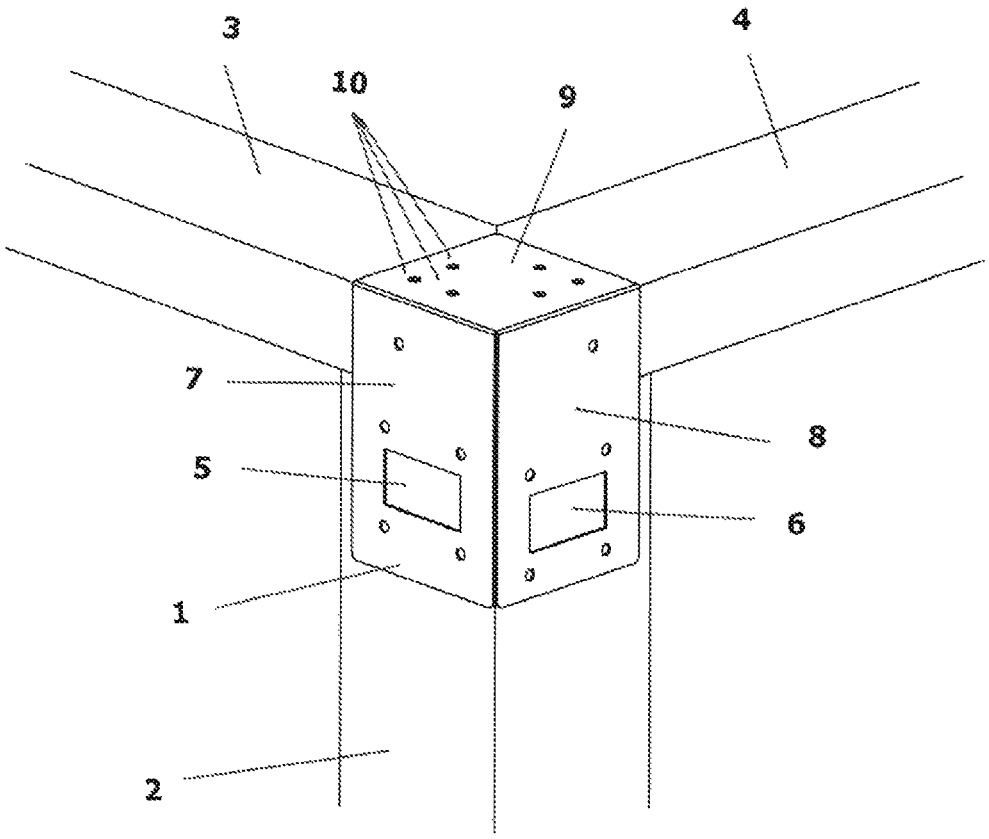
FIG. 7 illustrates an isometric view of an embodiment of a fence assembly adapted for use with one or more fence rails positioned above the fence post so that the fence rail is supported by the fence post and meeting at a right-angled corner in accordance with the present invention.
Figure 8:
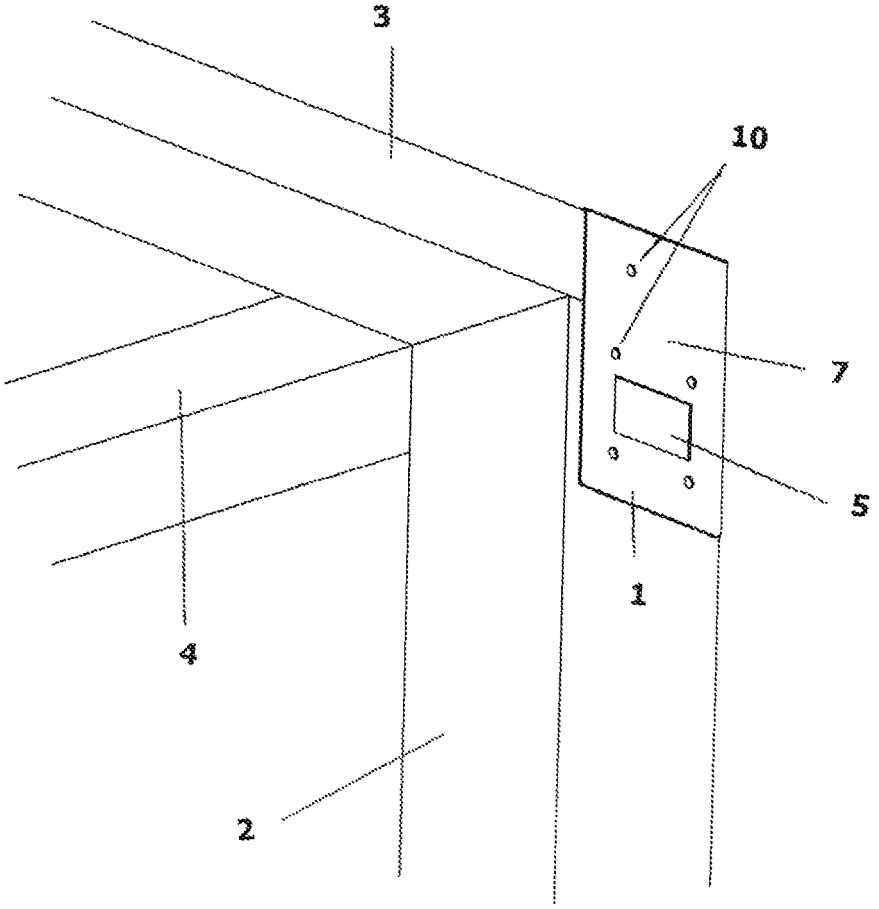
FIG. 8 illustrates an isometric view of an alternative embodiment illustrated in FIG. 7 of a fence assembly adapted for use with one or more fence rails positioned above the fence post so that the fence rail is supported by the fence post and meeting at a right-angled corner including a picket fastener slot shown in accordance with the present invention.
Figure 9:
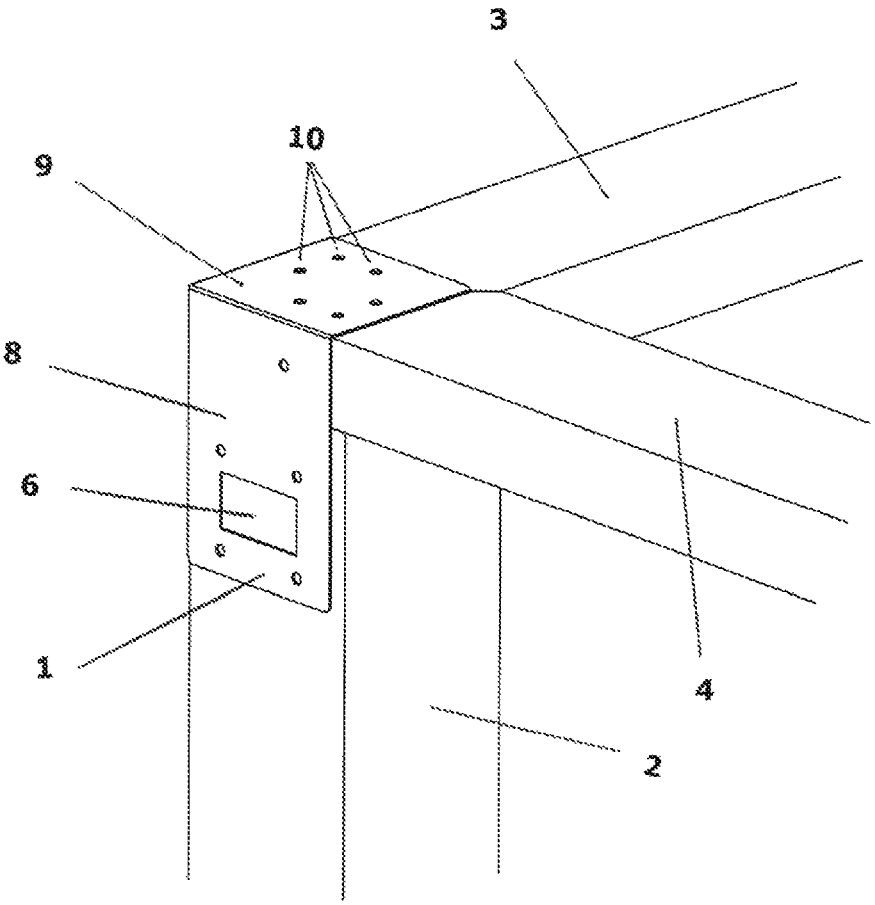
FIG. 9 illustrates an isometric view of a differing alternative embodiment illustrated in FIG. 8 of a fence assembly adapted for use with one or more fence rails positioned above the fence post so that the fence rail is supported by the fence post and a second picket fastener slot is shown in accordance with the present invention.

Referring to FIG. 7 through FIG. 9 alternative embodiments of the herein disclosed fence assembly are shown from various viewing angles that are adapted for use with one or more fence rail 3 and/or fence rail 4 positioned above and supported by fence post 2. These alternative embodiments may include: fence post 2 having a rectangular cross-section; fence rail 3 and/or fence rail 4 having a rectangular cross-section and positioned above and supported by fence post 2; a fence post brace member 1 forming a picket fastener slot 5 and/or picket fastener slot 6 for receiving a fastener therethrough to affix a picket to fence post 2 with the fence post member 1 therebetween; and the fence brace member 1 having a pair of right-angled sidewalls 7 and/or 8 with a horizontally longitudinally extending edge of the central wall 9 defining a channel for receiving fence rail 3 and/or fence rail 4 therein. A plurality of fastener holes 10 may be disposed within the central wall 9 and the pair of right-angled sidewalls 7 and/or 8 for receiving fasteners to secure fence rail 3 and/or fence rail 4 and fence post member 2 therein. Picket fastener slot 5 and/or picket fastener slot 6 may be formed by fence post brace member 1 for receiving a fastener therethrough to affix a picket to fence post 2.

Fence post brace member 7 and/or fence post brace member 8 and central wall member 9 may be formed of any material sufficiently rigid so as to provide adequate support to fence post 2—fence rail 3 and/or fence rail 4 connection. In a preferred embodiment, fence post brace member 7 and/or fence post brace member 8 and fence rail 3 and/or fence rail 4 are made of steel, stainless steel, galvanized steel, aluminum, plastic, graphite, or any composite material (s).

Referring to FIG. 7 through FIG. 9, fence post brace member 7 and/or fence post brace member 8 forms first picket fastener slot 5 and/or second picket fastener slot 6. Looking to FIG. 7, fence post brace member 1 may have right-angled sidewalls 7 and/or sidewall 8 defining a channel for receiving fence rail 3 and/or fence rail 4. Fence post sidewall 7 and/or fence post sidewall 8 forms a plurality of fastener holes 10 for receiving one or more fasteners to secure the fence brace to fence rail 3 and/or fence rail 4. Fence post sidewalls 7 defines a channel for receiving fence rail 3. In certain embodiments, picket fastener slot 5 and/or picket fastener 6 may extend longitudinally through fence post brace member 2. Fence post sidewall 8 may form a second picket fastener slot 6 for receiving a fastener therethrough to affix a second picket to fence post 2.

Fence post brace member is formed as a continuous sheet of material that may be formed as such during a manufacturing process and then bent into shape to form the embodiments illustrated in FIG. 7. In this way, manufacturing of the herein disclosed fence brace may be simplified or made more efficient. After formation as a single sheet of material, which may be accomplished through a punchcutting process, a metal stamping process, or any other manufacturing process, the fence brace may be bent into shape.

While the present invention has been illustrated and described herein in terms of a preferred embodiment and several alternatives, it is to be understood that the devices, systems, and assemblies described herein can have a multitude of additional uses and applications. Accordingly, the invention should not be limited to just the particular description and various drawing figures contained in this specification that merely illustrate a preferred embodiment and application of the principles of the invention.

What is claimed is:

1. A fence assembly comprising:

a fence post having a rectangular cross-section;

a fence rail having a rectangular cross-section and positioned above and supported by the fence post; and a fence brace formed from a single piece of material comprising:

a fence rail brace member comprising a planar central wall and a right-angled sidewall bent rearward from and extending along a horizontal longitudinally extending upper edge of the central wall, the central wall and right-angled sidewall of the fence rail brace member defining a fence rail channel for receiving the fence rail therein, and a plurality of fastener holes disposed within the central wall and right-angled sidewall of the fence rail brace member for receiving fasteners to secure the fence rail therewith; and a fence post brace member comprising a central wall and a pair of right-angled sidewalls each bent rearward from and extending along opposing vertical longitudinally-extending edges of the central wall, the fence post brace member central wall being coplanar with the fence rail brace member central wall and extending from a mid-point of a horizontal longitudinally-extending lower edge thereof opposite the upper edge, the right-angled sidewalls of the fence post brace member defining a fence post channel for receiving the fence post therein, edges of the right-angled sidewalls of the fence post brace member extending rearward from the lower edge opposite the fence rail brace member right-angled sidewall to define the fence rail channel therebetween, and a plurality of fastener holes disposed within the central wall and right-angled sidewalls of the fence post brace member for receiving fasteners to secure the fence post therewith; and a vertical picket fastener slot which longitudinally-extends through the fence post brace member central wall adjacent the lower edge of the fence rail brace member for receiving a fastener therethrough to affix a picket to the fence post with the fence post brace member therebetween.

2. The fence assembly of claim 1, wherein the fence brace is made of a material selected from the group consisting of steel, stainless steel, galvanized steel, aluminum, plastic, graphite, and a composite material.

3. The fence assembly of claim 1, further comprising at least one picket, wherein the picket is fastened to the fence post by passing a fastener through the picket and through the picket fastener slot and into the fence post.

4. The fence assembly of claim 1, wherein the fence rail is horizontally oriented.

5. The fence assembly of claim 1, wherein the fence post is vertically oriented.

* * * * *